US012037854B1

(12) United States Patent
Owoeye et al.

(10) Patent No.: US 12,037,854 B1
(45) Date of Patent: Jul. 16, 2024

(54) CONTROLLING A CASING RUNNING TOOL

(71) Applicant: Saudi Arabian Oil Company, Dhahran (SA)

(72) Inventors: Oladele Owoeye, Dhahran (SA); Jasem Moyaibed, Tarut (SA); Zakaria Al Bu, Sayaht (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/165,202

(22) Filed: Feb. 6, 2023

(51) Int. Cl.
*E21B 19/16* (2006.01)
*E21B 3/02* (2006.01)

(52) U.S. Cl.
CPC ..... *E21B 19/165* (2013.01); *E21B 3/022* (2020.05)

(58) Field of Classification Search
CPC ..... E21B 19/165; E21B 3/022
See application file for complete search history.

(56) References Cited

U.S. PATENT DOCUMENTS

| | | | |
|---|---|---|---|
| 3,457,605 | A | 7/1969 | Kingsbury et al. |
| 4,011,617 | A | 3/1977 | Toelke |
| 7,419,008 | B2 | 9/2008 | Campisi et al. |
| 7,874,352 | B2 | 1/2011 | Odell et al. |
| 7,946,356 | B2 | 5/2011 | Koederitz et al. |
| 8,356,675 | B2 | 1/2013 | Pietras et al. |
| 9,404,322 | B2 | 8/2016 | Wiedecke et al. |
| 2009/0272542 | A1 | 11/2009 | Begnaud et al. |
| 2011/0147010 | A1 | 6/2011 | Ellis |
| 2011/0226486 | A1 | 9/2011 | Haugen |
| 2012/0152530 | A1 | 6/2012 | Wiedecke et al. |
| 2012/0160517 | A1 | 6/2012 | Bouligny et al. |
| 2013/0075103 | A1 | 3/2013 | Herbel |
| 2013/0118760 | A1 | 5/2013 | Kuttel |
| 2014/0116686 | A1 | 5/2014 | Odell et al. |
| 2015/0191162 | A1 | 7/2015 | Dao |
| 2018/0023387 | A1 | 1/2018 | Turley et al. |
| 2018/0163500 | A1* | 6/2018 | Levert ..... E21B 33/04 |
| 2019/0106977 | A1* | 4/2019 | Amezaga ..... E21B 47/135 |
| 2019/0257161 | A1* | 8/2019 | Dewald ..... E21B 19/07 |
| 2020/0224524 | A1 | 7/2020 | Parmeshwar |
| 2020/0224525 | A1 | 7/2020 | Parmeshwar et al. |
| 2022/0268113 | A1 | 8/2022 | Owoeye et al. |
| 2023/0074177 | A1 | 3/2023 | Owoeye et al. |

FOREIGN PATENT DOCUMENTS

| | | |
|---|---|---|
| WO | WO 2013142950 | 10/2013 |

OTHER PUBLICATIONS

PCT International Search Report and Written Opinion in International Appln. No. PCT/US2022/017025, dated May 20, 2022, 18 pages.

* cited by examiner

*Primary Examiner* — Tara Schimpf
*Assistant Examiner* — Jennifer A Railey
(74) *Attorney, Agent, or Firm* — Fish & Richardson P.C.

(57) ABSTRACT

A top drive assembly includes a top drive, a casing running tool, and a gear assembly. The top drive is coupled to a rig. The casing running tool is fluidly coupled to and driven by the top drive. The gear assembly engages the top drive and the casing running tool to transmit torque from the top drive to the casing running tool. The gear assembly reverses a direction of torque between the top drive and the casing running tool or changes a rotational speed between the top drive and the casing running tool.

15 Claims, 7 Drawing Sheets

CONTROLLING A CASING RUNNING TOOL

FIELD OF THE DISCLOSURE

This disclosure relates to systems and methods for running and retrieving tubulars from a wellbore.

BACKGROUND OF THE DISCLOSURE

Top drive systems use casing running tools to run and retrieve tubulars from a wellbore during makeup and break out operations. Casing running tools engage and rotate a tubular to attach it or detach it from another tubular. Systems and methods to improve makeup and break out operations are sought.

SUMMARY

Implementations of the present disclosure include a top drive assembly that has a top drive, a casing running tool, and a gear assembly. The top drive is attached to a rig. The casing running tool is fluidly coupled to and driven by the top drive. The gear assembly engages the top drive and the casing running tool to transmit torque from the top drive to the casing running tool. The gear assembly reverses a direction of torque between the top drive and the casing running tool or changes a rotational speed between the top drive and the casing running tool.

In some implementations, the top drive and the casing running tool each include an external helix, and the gear assembly includes one or more gear shafts configured to engage the external helixes and transmit torque from the top drive to the casing running tool.

In some implementations, the gear assembly includes a plurality of gear shafts each controllable to selectively engage or disengage the external helixes, allowing the top drive to rotate at a different speed than or independently from the casing running tool.

In some implementations, the gear assembly includes two gear shafts each including two helixes of opposite hands, the two gear shafts configured to engage and rotate the casing running tool in a direction opposite to the top drive.

In some implementations, the gear assembly includes two gear shafts each including two helixes of common hand, one of the two helixes defining a dimension different from a dimension from the other of the two helixes such that, when engaged with the top drive and the casing running tool, the two gear shafts rotate the casing running tool at an output speed different from an input speed from the top drive.

In some implementations, the gear assembly includes two other gear shafts each including two other helixes of common hand. One of the two helixes defines a dimension different from a dimension from the other of the two other helixes such that, when engaged with the top drive and the casing running tool, the two other gear shafts rotate the casing running tool at a second output speed different from the output speed and different from the input speed from the top drive.

In some implementations, the top drive assembly further includes a system including one or more computers in one or more locations. The system transmits instructions to a controller coupled to an actuator configured to move, in response to instructions from the controller, at least one of i) the gear assembly to change speed or direction of rotation of the casing running tool or ii) the casing running tool to change an angle or position of the casing running tool.

In some implementations, the top drive assembly further includes a sensor system coupled to the casing running tool. The system determines, as a function of feedback from the sensor system, an angle of the casing running tool. The system compares the angle of the casing running tool to an angle of a wellbore, and determines that the angle of the casing running tool is different than the angle of the wellbore. The system transmits instructions to the controller to control the actuator to align the casing running tool with respect to the angle of the wellbore.

In some implementations, the sensor system includes a micro-electromechanical system (MEMS) gyroscope. The angle of the casing running toll includes an angle of a central longitudinal axis of the casing running tool, and the angle of the wellbore includes an angle of a central longitudinal axis of the wellbore.

In some implementations, the casing running tool is rotationally coupled to the top drive through a flexible pipe that allows moving an angle of a central longitudinal axis of the casing running tool with respect to an angle of a central longitudinal axis of the top drive.

In some implementations, the top drive assembly further includes a non-transitory computer-readable storage medium coupled to the system. The storage medium stores instructions that, when executed by the system, causes the system to perform operations including receiving feedback from one or more sensors at a powerslip coupled to a wellbore, and, as a function of the sensor feedback, releasing the powerslip.

Implementations of present disclosure include a method that includes engaging, with a casing running tool, a wellbore tubular. The method also includes rotating, by a top drive, the casing running tool to connect or disconnect the wellbore tubular to or from a second tubular. The top drive is configured to transmit torque to the casing running tool through a gear assembly configured to engage the top drive and the casing running tool. The rotating includes transmitting torque to the casing running tool through the gear assembly to at least one of reverse a direction of torque between the top drive and the casing running tool or change a rotational speed between the top drive and the casing running tool.

In some implementations, the method also includes aligning the casing running tool with a central longitudinal axis of a wellbore.

In some implementations, the rotating and aligning include automatically rotating and aligning, as a function of feedback from sensors or other input, the casing running tool during a makeup operation or a break out operation.

In some implementations, the gear assembly includes a plurality of gear shafts each controllable to selectively engage or disengage external helixes of the top drive and the casing running tool, and the rotating includes engaging and rotating two of the plurality of gear shafts by the respective external helix of the top, allowing the top drive to rotate at a different speed than or direction from the casing running tool.

DETAILED DESCRIPTION OF THE DISCLOSURE

The present disclosure describes a top drive assembly that allows the casing running tool to rotate at a different speed and direction than the top drive. The top drive assembly has a gear box with different gears that selectively engage the casing running tool to change a rotational speed and direction of the casing running tool.

Particular implementations of the subject matter described in this specification can be implemented so as to realize one or more of the following advantages. For example, the top drive assembly addresses some of the challenges that arise during make up, break out, and deployment of tubulars using a casing running tool (CRT). These issues include connection failure and loss of sealability, which are often caused by over-torqueing connections or misalignment of the CRT with the well center during stab-in and make up process. The misalignment can lead to cross threading the connection or inducing unnecessary bending stress on the connection. The top drive assembly of the present disclosure detects and addresses the misalignment automatically and also changes the torque and speed of the CRT to prevent over-torqueing.

Figure 1:
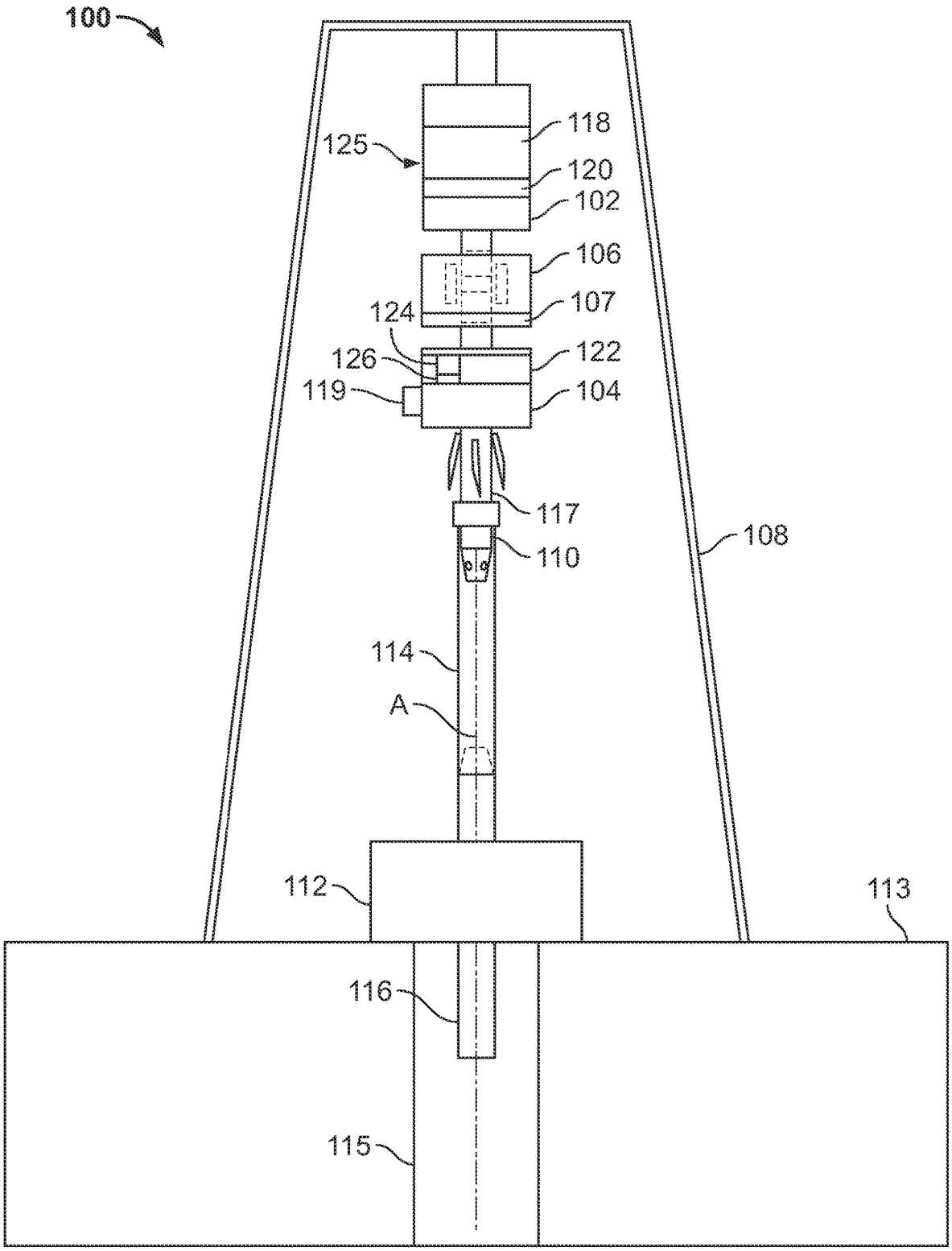
FIG. 1 is a front, partially cross-sectional schematic view of a top drive assembly according to implementations of the present disclosure.

FIG. 1 shows a top drive assembly or system 100 that resides at a terranean surface 113 of a wellbore 115. The top drive assembly 100 has a top drive 102, a casing running tool (CRT) 104, and a gear assembly or box 106. The top drive 102 is coupled to a rig 108. The CRT 104 is fluidly coupled to and driven by the top drive 102. The gear assembly 106 engages the top drive 102 and the CRT 104 to transmit torque from the top drive 102 to the CRT 104. The gear assembly 106 transmits torque to change the speed or reverse a rotational direction (e.g., a direction of torque) between the top drive 102 and the CRT 104. The gear assembly 106 changes the rotational speed between the top drive 102 and the CRT 104 by changing gears.

The top drive assembly 100 also includes a computer-implemented system 122 coupled to the CRT 104 or the top drive 102. The system 122 can also reside in a different location, including away from the rig 108. For example, the system 122 can be implemented as a distributed computer system disposed partly at the rig 108 and partly outside the rig 108.

The computer system includes one or more processors 124 and a computer-readable medium (e.g., a non-transitory computer-readable storage medium) storing instructions executable by the one or more processors 124 to perform the operations described here. In some implementations, the system 122 can be implemented as processing circuitry, firmware, software, or combinations of them. The system 122 includes a one or more controllers 126 (e.g., a programmable logic controller). The controller 126 is operably coupled to the gear assembly 106 and/or one or more actuators to control, based on information received from the processor 124, the inclination and rotational speed and direction of the CRT 104.

As further described in detail below with respect to FIG. 11, the top drive system 100 can also include a multi-purpose power lock system (e.g., an interlock system) integrated with the power slips 112. Additionally, the CRT 104 has a mandrel 117 with slips 110 that engage the interior wall of a tubular 114. The CRT 104 rotates to threadedly couple or decouple the tubular 114 to or from a second tubular 116. This can be done while the power slips 112 hold the second tubular 116.

The top drive system includes a sensor system 125. For example, the sensor system 125 can be part of the top drive 102 and include a wireless torque sub 118, a top drive system (TDS) torque encoder 120, and other sensors such as temperature and pressure sensors. The sensor system also includes a gyroscope 107 (e.g., an electromechanical system (MEMS) gyroscope). In some implementations, the wireless torque sub 118 and TDS torque encoder 120 can be attached to the CRT 104 (or they can reside in a different location of the top drive assembly 100). In some implementations, instead of or in addition to a TDS torque encoder 120, the system can have a drive stem system, a torque—turn recorder system, or a visual display system. The wireless torque sub 118 supports torque-turn control for casing-running joint validation using top drive or casing running tools. A torque turn sub is screwed into the top drive and runs while you are actively running your service. The wireless torque sub 118 can have sensors that sense or measure torque, tension (hook load), turns (rotation), vibration, acceleration, deceleration, and RPM of the CRT 104 and the top drive 102. This information allows the system 100 to determine the torque, tension, or turns being delivered from the top drive 102, and to make a determination of how to control the gear assembly 106.

The system 122 is a closed-loop feedback control system that changes gears based on feedback from the system sensors. For example, the system 122 can feature a two-way communication or interaction between the CRT 104 (or the wireless torque sub 118) and the torque encoder 120. The wireless torque sub 118 measures the weight on the joint/connection during stabbing of the connection with the CRT 104 to eliminate excessive weight on the joint/connection during stabbing, especially where a stab-in guide has not been used. The wireless torque sub 118 can enable TDS torque measurement, feedback control, analyzing the efficiency of the TDS gear system that provides power from the motor to the main shaft of the top drive, torque measurement from the rig encoder system, comparison of the torque readings from rig and wireless sub system, or alignment of the CRT 104 or top drive 102 with the well center. For example, the CRT 104 is moved to be aligned with respect to the angle of a central longitudinal axis "A" of the wellbore 115. The system 122 can be used as a torque verification system that triggers an alarm when the torque between the TDS torque encoder output and readings from the torque encoder exceeds the recommended preset value. The results can be part of a display on the torque turn readout or a visual display unit.

The gear assembly 106 helps constrain relative motion to only the desired motion and/or reduce or increase the RPM of the CRT 104 during the connection make up process and connection beak off process. While torque and rotation are transmitted from the top drive 102 to the CRT 104, the gear assembly allows the top drive 102 to deliver different types of rotation depending on the latching gear position of the CRT 104.

The system 100 can also include a vibration isolator 119 that reduces or suppresses unwanted vibration transmitted from the top drive 102 to the CRT 104, especially during stabbing and make up process. The vibration isolator 119 reduces vibration of the CRT 104 or the top drive 102 or both to allow the system to more accurately measurement the torque and RPM and other parameters. The vibration isolator 119 can be, for example, a spring coil pneumatic, steel coil, or rubber (elastomeric). The vibration isolator 119 can be moved by one or more of the actuators that the system 122 controls, allowing the vibration isolator 119 to selectively reduce noise (e.g., when noise is above a certain threshold).

Figure 2:
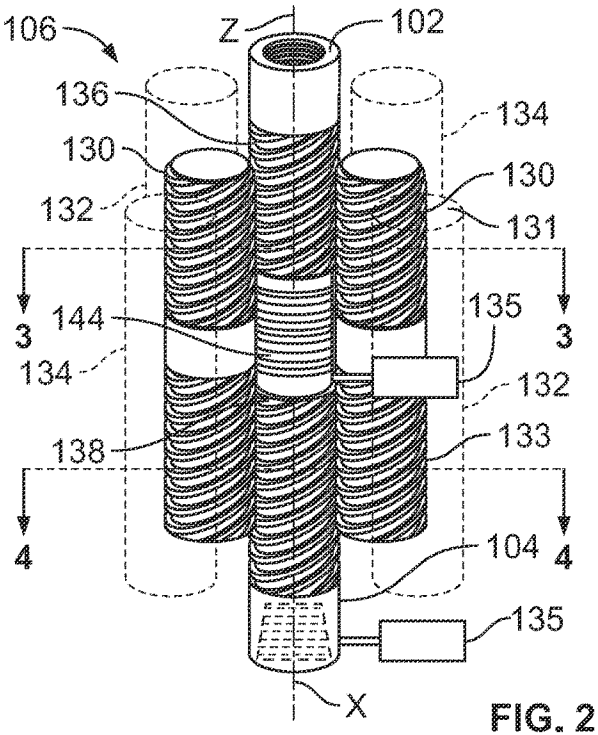
FIG. 2 is a perspective schematic view of a gear assembly in a first setting.

FIG. 2 illustrates an example gear assembly 106 according to implementations of the present disclosure. As shown, the gear assembly 104 has multiple gear shafts 130, 132, 134 that selectively engage and disengage the top drive depending on the type of application or performance required. For example, the gear assembly 106 has three pairs of gear shafts so that the CRT 104 is able to operate with three different drives: low gear, high gear, and reverse rotation. The first pair of gears has two low gear shafts 130 that engage the top drive 102 and the CRT 104 from opposite sides. Similarly, the second pair of gears includes two high gear shafts 132 that engage the top drive 102 and the CRT 104 from opposite sides. Lastly, the third pair of gears includes two reverse gear shafts 134 that engage the top drive 102 and the CRT 104 from opposite sides.

Figure 8:
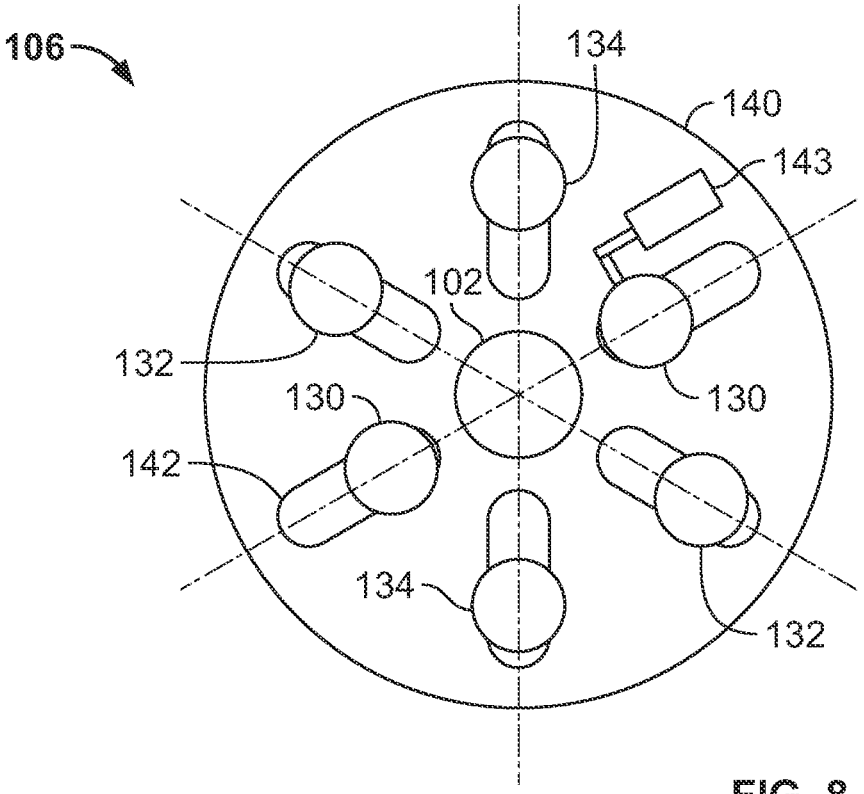
FIG. 8 is a top schematic view of a gear assembly in a first setting.
Figure 9:
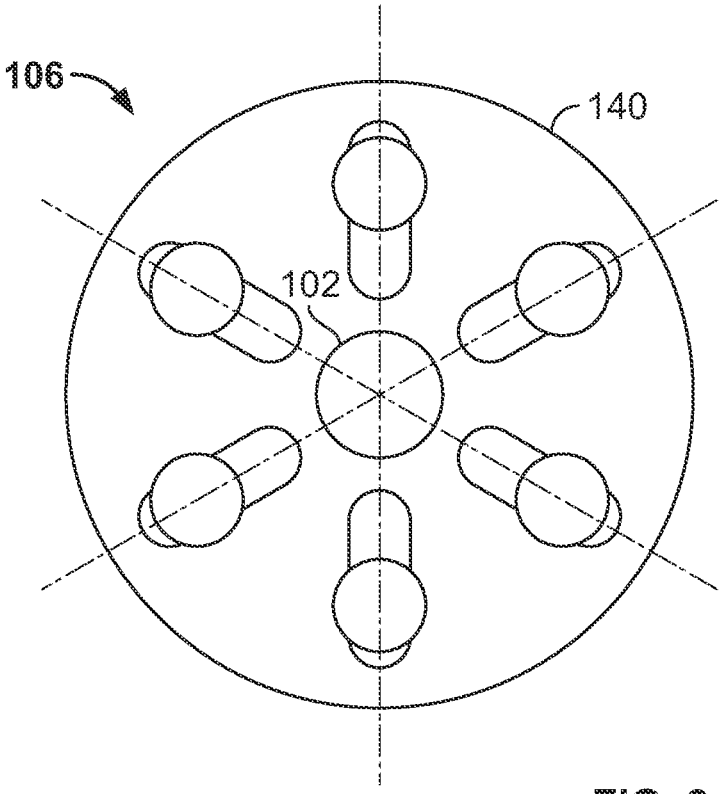
FIG. 9 is a top schematic view of a gear assembly in a second setting.

Referring briefly to FIGS. 8 and 9, the gear assembly 106 can have a disk 140 with slots 142 that constrain each pair of gear shafts 130, 132, 134 to move in a common direction to engage and disengage the top drive 102 and the CRT 104. Only one pair of gears engages the top drive 102 and the CRT 104 at the same time. For example, as shown in FIG. 8, only the two low gear shafts 130 are in the engaged position to engage the top drive 102 and the CRT 104 to reduce the rotational speed transmitted from the top drive 102 to the CRT 104. As shown in FIG. 9, all the gear shafts can disengage the top drive 102 and the CRT 104 to prevent any torque from being transmitted from the top drive 102 to the CRT 104. Each gear shaft is controllable to selectively engage or disengage the top drive 102 to the CRT 104, allowing the top drive 102 to rotate at a different speed than or independently from the CRT 104. For example, each gear shaft can be moved by one or a respective actuator 143 (only one shown for simplicity purposes) that is controlled by the controller of the system 122 described in FIG. 1.

Referring back to FIG. 2, the top drive 102 and the CRT 104 each have an external helix 136, 138, and gear shafts have corresponding helixes or teeth that engage the external helixes 136, 138 and transmit torque from the top drive 102 to the CRT 104. The low gear and high gear pairs of shafts 130, 132 have two helixes of common hand. For example, gear shaft 130 has an input helix 131 and an output helix 133, and each helix 131, 133 has a different dimension from the other such that, when engaged with the top drive 102 and the CRT 104, the two gear shafts rotate the CRT 104 at an output speed different from an input speed from the top drive 102. For example, one helix can have a greater outer diameter than the other helix, or one helix can have a wider pitch than the other helix.

The CRT 104 is rotationally coupled to the top drive 102 through a flexible pipe or hose 144 that allows moving an angle of a central longitudinal axis "X" of the CRT 104 with respect to an angle of a central longitudinal axis "Z" of the top drive 102 (or with respect to the axis "A" of the wellbore). For example, the CRT 104 can be moved or aligned by one or more actuators 135 that are controlled by the controller of the system 122 described in FIG. 1. Specifically, the system determines, based on feedback from the sensor system, an angle of the CRT 104, compares the angle of the CRT 104 (e.g., angle of a central longitudinal axis of the CRT 104) to an angle of a wellbore (e.g., angle of a central longitudinal axis of the wellbore), determines that the angle of the CRT 104 is different than the angle of the wellbore, and controls the actuator to align the CRT 104 with respect to the angle of the wellbore.

The gyroscope system 107 measures the angle of the top drive 102 or the angle of the CRT 104. The system uses the information measured by the gyroscope 107 to evaluating the differential angle or position between CRT 104 and the well center during connection make up and deployment process. This minimizes the risk of cross-threading, damage to thread, seal and shoulder of a connection, and the bending stress on the CRT 104. The gyroscope system 107 or the system 122 or both define the position of the reference frame to determine the angle of the CRT 104. The reference frame is the well center or the Blowout Preventer (BOP) on onshore and offshore applications. The BOP can be used as the reference frame for defining the position of the well center.

Figure 3:
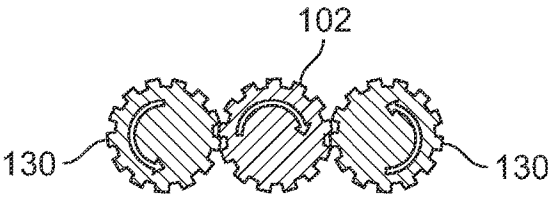
FIG. 3 is a top cross-sectional view along section 3-3 in FIG. 2.
Figure 4:
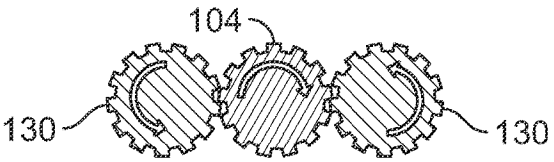
FIG. 4 is a top cross-sectional view along section 4-4 in FIG. 2.

As shown in FIGS. 3 and 4, the gears 130 transfer rotation from the top drive 102 to the CRT 104 in the same direction. The low gear shafts 130 reduce the rotational speed, meaning that the CRT 104 rotates at a lower speed than the speed of the top drive 102.

Figure 5:
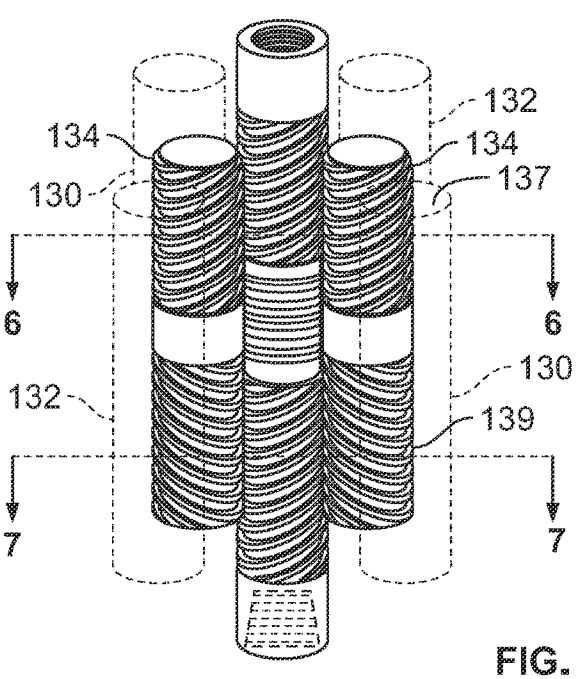
FIG. 5 is a perspective schematic view of a gear assembly in a second setting.

FIG. 5 illustrates the two reverse gear shafts 134 engaging the top drive 103 and the CRT 104. Each reverse gear shaft 134 has two helixes 137, 139 of opposite hands. The two gear shafts engage and rotate the CRT 104 in a direction opposite to the top drive 102. The CRT 104 can be attached to a bearing that allows rotation of the CRT 104 in an opposite direction.

Figure 6:
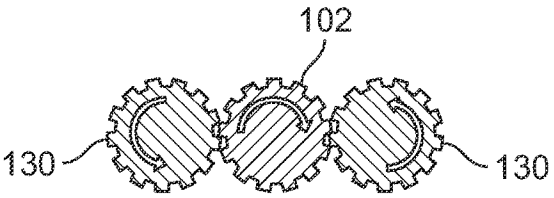
FIG. 6 is a top, cross-sectional schematic view along section 6-6 in FIG. 5.
Figure 7:
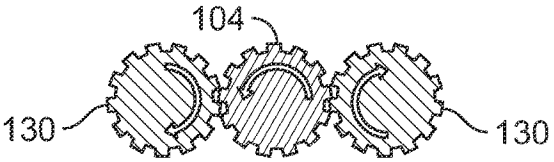
FIG. 7 is a top, cross-sectional schematic view along section 7-7 in FIG. 5.

As shown in FIGS. 6 and 7, the gears 134 transfer rotation from the top drive 102 to the CRT 104 in the opposite direction. The reverse gear shafts 134 can maintain the same rotational speed or change the rotational speed.

The system 122 determines the torque being transmitted to the CRT 104 and ensures that the RPM transmitted from the top drive 102 to the CRT 104 does not exceed the recommended connection original equipment manufacturer (OEM) make up values at initial stabbing in, running in, and final makeup, including seal and shoulder engagement of the connection where applicable.

For example, for premium connections with seal and shoulder engagement, the final makeup of the connection can be done in low gear corresponding to low RPM (e.g., 2 to 5 RPM). This ensures controlled make up, reduced risk of over-torqueing the connection, and reduced risk of damaging the seal area. Additionally, when used in casing drilling applications or rotating liner or casing to bottom, the system can be operated in high gear to increase RPM and/or torque to the operational limit torque or make up torque of the selected connection depending on the operating condition. However, when tubular is stuck during deployment, the system can limit the applied torque to the makeup of the selected tubular. Both torque limits can be preset in the system 122 and are compared by the system 122 to the torque reading measured by the wireless torque sub 118. Similarly, the system 122 can be operated with no rotation allowed below the CRT 104 and the top drive 102. No rotation is triggered, for example, during casing or liner drilling or when rotating tubular becomes stuck. Once the system 122 determines (e.g., based on input data from the sensors not limited to pressure, flow rate, rpm torque, etc.) that there is a stuck incident, the controller 126 triggers deactivation of the torque transfer gear to the unlatched position. Deactivation of the transfer torque gear prevents damage to the connection or deformation of the tubular in the gripping area.

The system described above is able to switch automatically between gears depending on the status of the makeup process, the drilling process, or the breakout process. In some implementations, the movement of the gears can be manual where the makeup and breakout process is controlled by a human operator.

Figure 10:
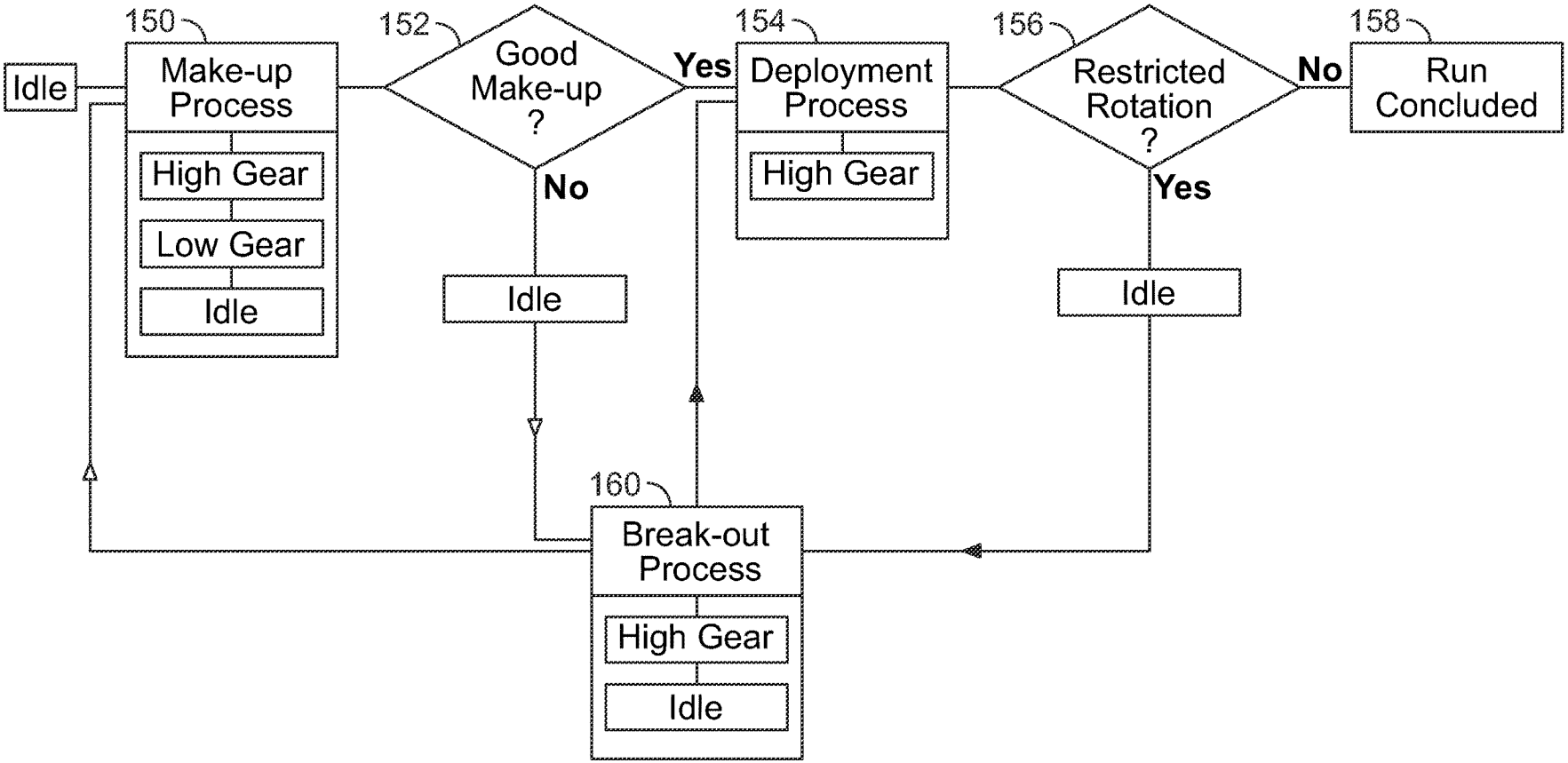
FIG. 10 is a flow diagram showing a logic algorithm with steps for controlling the rotation of a casing running tool, according to some implementations of the present disclosure.

FIG. 10 shows a flow diagram of an example logic algorithm with steps for controlling the rotation of the casing running tool 104 during the makeup process and the breakup process. In block 150, the system is in makeup mode. In makeup mode, the system can be in high-gear mode, low-gear mode, or idle mode. In block 152, the system uses sensor feedback to determine if the makeup is good or not. If the makeup is good, the system can proceed to change to deployment mode, as shown in block 154. If the makeup is not good, the system changes to breakout mode, as shown in block 160. During breakout mode, the system can operate in high hear mode or in idle mode. Once the breakout process is finished, the system begins the makeup process again. As shown in block 156, during deployment, the system determines if the rotation is being restricted (e.g., determine if the pipe is stuck). If the rotation is restricted, the system goes into idle mode and begins the break out process. If the rotation is not restricted, the deployment is continued.

Figure 11:
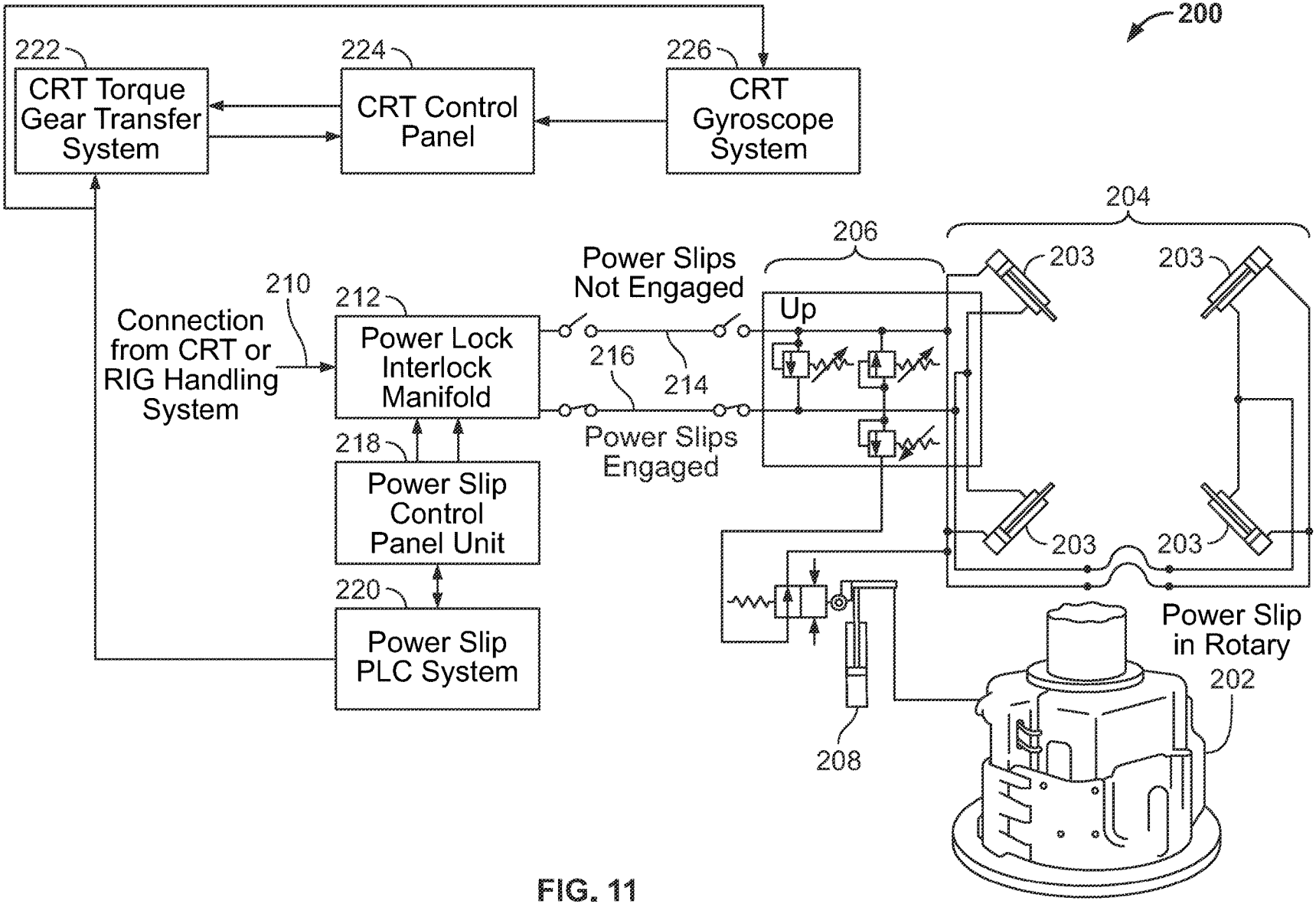
FIG. 11 is a schematic diagram showing an example of a powerslip system set up as a power lock and powerslip system, according to some implementations of the present disclosure.

FIG. 11 shows a power slip system 200 that includes power slips 202 (e.g., the same as power slips 112 shown in FIG. 1). The power slip system 200 has one or more sensors 208 that the system 122 utilizes to control (e.g., releasing or engage) the power slips 202. The power slip 202 is in a rotary. The system 200 also includes an individual piston 203 for the retractable slips, a retractable slips system 204, an electrical control unit 206 for the retractable slips system, and a weight sensor system 208. The power slip system 200 provides a connection 210 from the CRT 104 or rig handling system, allowing received data and instructions to be processed by a power lock interlock system 212, also receiving inputs from a power slip control panel unit 218. A power slip programmable logic controller (PLC) system 220 can provide logic control for the power slip control panel unit 218. The power lock interlock system 212 can identify power slips not engaged 214 and power slips engaged 216. The power slip PLC system 220 is communicatively coupled to the CRT torque gear transfer system 222 and to the CRT gyroscope system 226 to help control the CRT 104. The CRT torque gear transfer system 222 and the CRT gyroscope system 226 are connected to a CRT control panel 224 (e.g., the controller 122 in FIG. 1) to transmit information (e.g., gyroscope feedback, power slip system feedback, and other sensor feedback) to the CRT control panel 224 so that the CRT control panel 224 either aligns the CRT 104 or changes a direction or speed of rotation of the CRT 104.

Figure 12:
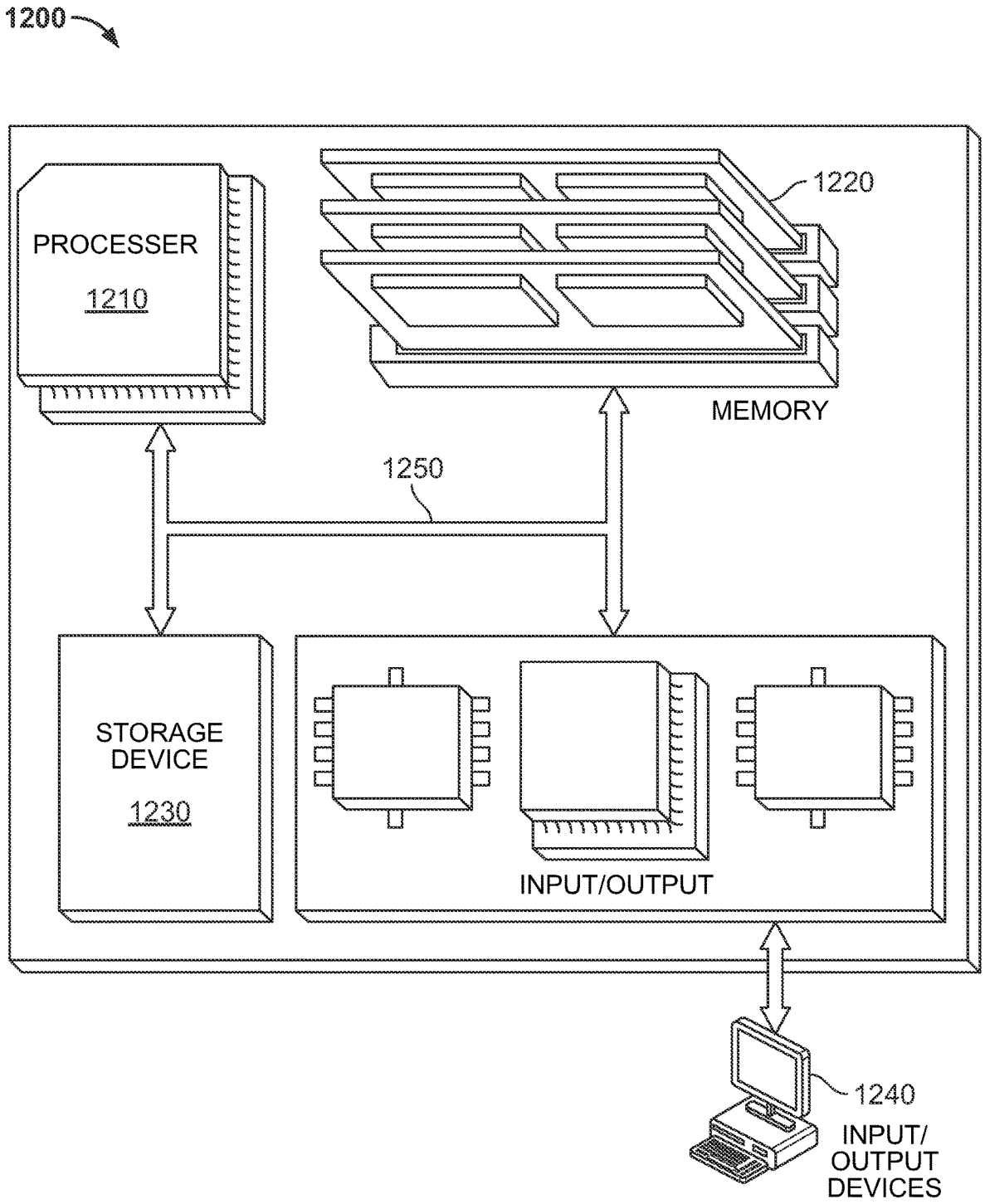
FIG. 12 is a schematic illustration of an example control system or controller of the top drive system, according to some implementations of the present disclosure.

The power slip PLC system 220 can include at least one processor, memory, a storage device, and an input/output device, similar to the system shown in FIG. 12. The components can be interconnected using a system bus. The power slip system 200 can be integrated with the CRT system 122 to evaluate the misalignment of the CRT 104 with the well center. The interlock system 200 can be integrated with any rig handling equipment such as the top drive or elevators, etc. The multi-purpose power lock system can consist of any electrical, electronic, or mechanical devices or systems. The multi-purpose power lock system makes the state of two mechanisms or functions mutually dependent. However, in case of misalignment between the CRT 104 and the well center detected during connection make up process, the CRT 104 and the power slip can remain engaged to the tubular and a signal is sent to the CRT operator to note the misalignment and degree of misalignment with the well center. The connection make up process can continue after the CRT 104 is again aligned with the well center.

The power slip system 200 can provide the necessary failsafe logic with the intelligent power slip and the power lock to prevent a casing from slipping and dropping in hole when the casing running tool or handling tool is released. The system can can review a combination of engagement (slip up) measurements to confirm engagement of the power slip such as Slip Up pressure measurement, fluid flow measurement, and location sensor on the power slip retractable slips. The combination of this measurement can be compared with the required pressure measurement and fluid volume for the given tubular size. The approach is able to detect anomalies in the power slip engagement. The system 200 can monitor the weight transfer between the CRT 104 and the power slip, while not allowing release of the CRT 104 if the string weight has not been fully transferred to the powerslip. For example, the release of the CRT 104 from the tubular will not be permitted (even if the Slips Up have been confirmed by the system) if the weight has not been fully transferred from the CRT 104 to the Powerslip in the rotary table.

In some implementations, an intelligent powerslip and power lock system (IPPLS) (or "system") of the present disclosure can serve as a smart tubular deployment system ensuring that the state of two mechanisms or functions are mutually dependent. The dependency can be based at least in part on a logic function. The conditions can also include "Elevator tilt arm on CRT not activated with powerslip in Slip Up position," "Rig handling tool not engaged," and "Powerslip in Slip Up position."

The PLC can monitor various input sensing devices such as weight sensors, location indicator sensors of the retractable slips, pressure and temperature sensors from actuator control lines, pressure and temperature readings on power units, return lines, powerslips, manifolds, accumulators and reducers, and fluid flow measurement. Based on the monitoring, the system can produce corresponding output, which ultimately functions to either keep the powerslip in Slip Up or Slip Down positions in order to engage or disengage the tubular as required.

FIG. 12 is a schematic illustration of an example control system or controller for a top drive system according to the present disclosure. For example, the controller 1200 can include or be part of the controllers 126 shown in FIG. 1.

Additionally, the controller 1200 can include or be part of the PLC system 220 shown in FIG. 11. The controller 1200 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives can store operating systems and other applications. The USB flash drives can include input/output components, such as a wireless transmitter or USB connector that can be inserted into a USB port of another computing device.

The controller 1200 includes a processor 1210, a memory 1220, a storage device 1230, and an input/output device 1240. Each of the components 1210, 1220, 1230, and 1240 are interconnected using a system bus 1250. The processor 1210 is capable of processing instructions for execution within the controller 1200. The processor can be designed using any of a number of architectures. For example, the processor 1210 can be a CISC (Complex Instruction Set Computers) processor, a RISC (Reduced Instruction Set Computer) processor, or a MISC (Minimal Instruction Set Computer) processor.

In one implementation, the processor 1210 is a single-threaded processor. In another implementation, the processor 1210 is a multi-threaded processor. The processor 1210 is capable of processing instructions stored in the memory 1220 or on the storage device 1230 to display graphical information for a user interface on the input/output device 1240.

The memory 1220 stores information within the controller 1200. In one implementation, the memory 1220 is a computer-readable medium. In one implementation, the memory 1220 is a volatile memory unit. In another implementation, the memory 1220 is a non-volatile memory unit.

The storage device 1230 is capable of providing mass storage for the controller 1200. In one implementation, the storage device 1230 is a computer-readable medium. In various different implementations, the storage device 1230 can be a floppy disk device, a hard disk device, an optical disk device, or a tape device. In various different implementations, the storage device 1230 can be a data base that allows the system to manage multiple storage stacks.

The input/output device 1240 provides input/output operations for the controller 1200. In one implementation, the input/output device 1240 includes a keyboard and/or pointing device. In another implementation, the input/output device 1240 includes a display unit for displaying graphical user interfaces.

Figure 13:
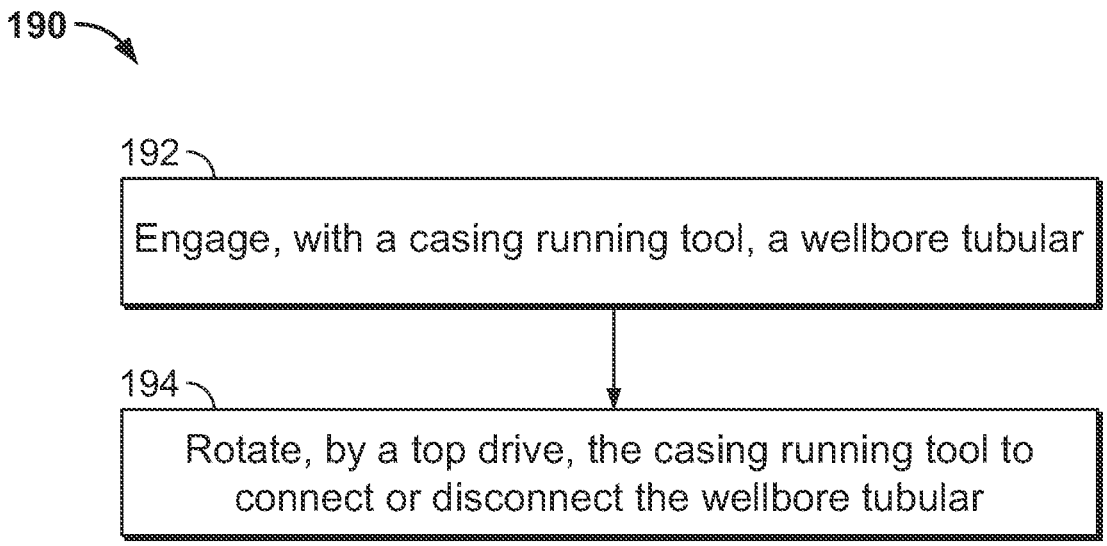
FIG. 13 is a flow chart of an example method of controlling the rotation of a casing running tool, according to some implementations of the present disclosure.

FIG. 13 shows a flow chart of an example method (190) that includes the steps of engaging, with a casing running tool, a wellbore tubular (192). The method also includes rotating, by a top drive, the casing running tool to connect or disconnect the wellbore tubular to or from a second tubular (194). The top drive transmits torque to the casing running tool through a gear assembly configured to engage the top drive and the casing running tool. The rotating comprises transmitting torque to the casing running tool through the gear assembly to at least one of reverse a direction of torque between the top drive and the casing running tool or change a rotational speed between the top drive and the casing running tool.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A top drive assembly, comprising:

a top drive configured to be coupled to a rig;

a casing running tool configured to be fluidly coupled to and driven by the top drive; and a gear assembly configured to engage the top drive and the casing running tool to transmit torque from the top drive to the casing running tool, the gear assembly configured to at least one of reverse a direction of torque between the top drive and the casing running tool or change a rotational speed between the top drive and the casing running tool.

2. The top drive assembly of claim 1, wherein the top drive and the casing running tool each comprise an external helix, and the gear assembly comprises one or more gear shafts configured to engage the external helixes and transmit torque from the top drive to the casing running tool.

3. The top drive assembly of claim 2, wherein the gear assembly comprises a plurality of gear shafts each controllable to selectively engage or disengage the external helixes, allowing the top drive to rotate at a different speed than or independently from the casing running tool.

4. The top drive assembly of claim 2, wherein the gear assembly comprises two gear shafts each comprising two helixes of opposite hands, the two gear shafts configured to engage and rotate the casing running tool in a direction opposite to the top drive.

5. The top drive assembly of claim 2, wherein the gear assembly comprises two gear shafts each comprising two helixes of common hand, one of the two helixes defining a dimension different from a dimension from the other of the two helixes such that, when engaged with the top drive and the casing running tool, the two gear shafts rotate the casing running tool at an output speed different from an input speed from the top drive.

6. The top drive assembly of claim 5, wherein the gear assembly comprises two other gear shafts each comprising two other helixes of common hand, one of the two helixes defining a dimension different from a dimension from the other of the two other helixes such that, when engaged with the top drive and the casing running tool, the two other gear shafts rotate the casing running tool at a second output speed different from the output speed and different from the input speed from the top drive.

7. The top drive assembly of claim 1, further comprising a system comprising one or more computers in one or more locations, the system configured to transmit instructions to a controller coupled to an actuator configured to move, in response to instructions from the controller, at least one of i) the gear assembly to change speed or direction of rotation of the casing running tool or ii) the casing running tool to change an angle or position of the casing running tool.

8. The top drive assembly of claim 7, further comprising a sensor system coupled to the casing running tool, the system configured to:

determine, as a function of feedback from the sensor system, an angle of the casing running tool, compare the angle of the casing running tool to an angle of a wellbore, determine that the angle of the casing running tool is different than the angle of the wellbore, and transmit instructions to the controller to control the actuator to align the casing running tool with respect to the angle of the wellbore.

9. The top drive assembly of claim 8, wherein the sensor system comprises a micro-electromechanical system (MEMS) gyroscope, the angle of the casing running tool comprises an angle of a central longitudinal axis of the casing running tool, and the angle of the wellbore comprises an angle of a central longitudinal axis of the wellbore.

10. The top drive assembly of claim 8, wherein the casing running tool is rotationally coupled to the top drive through a flexible pipe that allows moving an angle of a central longitudinal axis of the casing running tool with respect to an angle of a central longitudinal axis of the top drive.

11. The top drive assembly of claim 7, further comprising a non-transitory computer-readable storage medium coupled to the system and storing instructions that, when executed by the system, causes the system to perform operations comprising:

receiving feedback from one or more sensors at a powerslip coupled to a wellbore; and as a function of the sensor feedback, releasing the powerslip.

12. A method, comprising:

engaging, with a casing running tool, a wellbore tubular;

rotating, by a top drive, the casing running tool to connect or disconnect the wellbore tubular to or from a second tubular;

wherein the top drive is configured to transmit torque to the casing running tool through a gear assembly configured to engage the top drive and the casing running tool, and the rotating comprises transmitting torque to the casing running tool through the gear assembly to at least one of reverse a direction of torque between the top drive and the casing running tool or change a rotational speed between the top drive and the casing running tool.

13. The method of claim 12, further comprising aligning the casing running tool with a central longitudinal axis of a wellbore.

14. The method of claim 13, wherein the rotating and aligning comprise automatically rotating and aligning, as a function of feedback from sensors or other input, the casing running tool during a makeup operation or a break out operation.

15. The method of claim 12, wherein the gear assembly comprises a plurality of gear shafts each controllable to selectively engage or disengage external helixes of the top drive and the casing running tool, and the rotating comprises engaging and rotating two of the plurality of gear shafts by the respective external helix of the top, allowing the top drive to rotate at a different speed than or direction from the casing running tool.

* * * * *